US011848004B2

(12) United States Patent
Park et al.

(10) Patent No.: US 11,848,004 B2
(45) Date of Patent: Dec. 19, 2023

(54) ELECTRONIC DEVICE AND METHOD FOR CONTROLLING THEREOF

(71) Applicant: SAMSUNG ELECTRONICS CO., LTD., Suwon-si (KR)

(72) Inventors: Sangjun Park, Suwon-si (KR); Kihyun Choo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 17/850,096

(22) Filed: Jun. 27, 2022

(65) Prior Publication Data

US 2022/0406293 A1 Dec. 22, 2022

Related U.S. Application Data

(63) Continuation of application No. PCT/KR2022/006304, filed on May 3, 2022.

(30) Foreign Application Priority Data

Jun. 22, 2021 (KR) ..... 10-2021-0081109
Dec. 31, 2021 (KR) ..... 10-2021-0194532

(51) Int. Cl.
*G10L 13/04* (2013.01)
*G10L 13/08* (2013.01)
(Continued)

(52) U.S. Cl.
CPC ..... *G10L 13/10* (2013.01); *G10L 13/047* (2013.01); *G10L 13/06* (2013.01)

(58) Field of Classification Search
CPC ..... G10L 13/04; G10L 13/08; G10L 19/16; G10L 25/30
See application file for complete search history.

(56) References Cited

U.S. PATENT DOCUMENTS 10,108,606 B2 10/2018 Yun et al.
11,074,909 B2 7/2021 Lee et al.
(Continued)

FOREIGN PATENT DOCUMENTS

CN 111179910 A * 5/2020 ..... G06N 3/0445
CN 111356010 A * 6/2020
(Continued)

OTHER PUBLICATIONS

Hsu et al., "Hierarchical Generative Modeling for Controllable Speech Synthesis," Published as a conference paper at ICLR 2019, Dec. 27, 2018, Total 27 pages.
(Continued)

*Primary Examiner* — Shreyans A Patel
(74) *Attorney, Agent, or Firm* — Sughrue Mion, PLLC

(57) ABSTRACT

A method for controlling an electronic device includes obtaining a text, obtaining, by inputting the text into a first neural network model, acoustic feature information corresponding to the text and alignment information in which each frame of the acoustic feature information is matched with each phoneme included in the text, identifying an utterance speed of the acoustic feature information based on the alignment information, identifying a reference utterance speed for each phoneme included in the acoustic feature information based on the text and the acoustic feature information, obtaining utterance speed adjustment information based on the utterance speed of the acoustic feature information and the reference utterance speed for each phoneme, and obtaining, based on the utterance speed adjustment information, speech data corresponding to the text by inputting the acoustic feature information into a second neural network model.

20 Claims, 10 Drawing Sheets

(51) Int. Cl.

| | |
|---|---|
| ***G10L 19/16*** | (2013.01) |
| ***G10L 25/30*** | (2013.01) |
| ***G10L 13/10*** | (2013.01) |
| ***G10L 13/047*** | (2013.01) |
| ***G10L 13/06*** | (2013.01) |

(56) References Cited

U.S. PATENT DOCUMENTS

| | | | | |
|---|---|---|---|---|
| 11,107,456 | B2 | 8/2021 | Chae et al. | |
| 2008/0319755 | A1 | 12/2008 | Nishiike et al. | |
| 2009/0006098 | A1* | 1/2009 | Nishiike | G10L 13/10 704/260 |
| 2017/0255616 | A1* | 9/2017 | Yun | G10L 13/0335 |
| 2020/0005763 | A1* | 1/2020 | Chae | G10L 13/047 |
| 2020/0410992 | A1 | 12/2020 | Lee et al. | |
| 2021/0350788 | A1* | 11/2021 | Choo | G10L 13/08 |

FOREIGN PATENT DOCUMENTS

| | | | | | |
|---|---|---|---|---|---|
| CN | 113689879 | A | * | 11/2021 | |
| CN | 115346421 | A | * | 11/2022 | |
| CN | 113436600 | B | * | 12/2022 | |
| CN | 115424616 | A | * | 12/2022 | |
| GB | 2591245 | A | * | 7/2021 | G10L 13/00 |
| GB | 2591245 | A | | 7/2021 | |
| JP | 2009-3394 | A | | 1/2009 | |
| JP | 4232254 | B2 | | 3/2009 | |
| JP | 4232254 | B2 | * | 3/2009 | |
| JP | 4973337 | B2 | | 7/2012 | |
| JP | 2014-123072 | A | | 7/2014 | |
| JP | 2019-215468 | A | | 12/2019 | |
| JP | 2019-219590 | A | | 12/2019 | |
| KR | 1020100003111 | A | | 1/2010 | |
| KR | 1020170103209 | A | | 9/2017 | |
| KR | 1020190104269 | A | | 9/2019 | |
| KR | 1020210001937 | A | | 1/2021 | |
| KR | 10-2021-0095010 | A | | 7/2021 | |
| WO | 2021/002967 | A1 | | 1/2021 | |

OTHER PUBLICATIONS

Search Report dated Aug. 19, 2022 by the ISA for International Application No. PCT/KR2022/006304 (PCT/ISA/210).

Written Opinion dated Aug. 19, 2022 by the ISA for International Application No. PCT/KR2022/006304 (PCT/ISA/237).

Yaniv Taigman et al., Voiceloop: Voice Fitting and Synthesis Via a Phonological Loop, arXiv:1707.06588v3 [cs.LG], pp. 1-14, Feb. 2018.

* cited by examiner

FIG. 7

$$\tilde{x}_n = \begin{cases} x_1 & , t = 1 \\ \alpha \cdot x_n + (1 - \alpha) \cdot \tilde{x}_{n-1} & , t > 1 \end{cases}$$

ELECTRONIC DEVICE AND METHOD FOR CONTROLLING THEREOF

CROSS-REFERENCE TO RELATED APPLICATION(S)

This application is a bypass continuation of International Application No. PCT/KR2022/006304, filed on May 3, 2022, which is based on and claims priority to Korean Patent Application No. 10-2021-0081109, filed on Jun. 22, 2021 and No. 10-2021-0194532, filed on Dec. 31, 2021, in the Korean Intellectual Property Office, the disclosures of which are incorporated by reference herein in their entireties

BACKGROUND

1. Field

The disclosure relates generally to an electronic device and a method for controlling thereof. More particularly, the disclosure relates to an electronic device that performs speech synthesis using an artificial intelligence model and a method for controlling thereof.

2. Description of the Related Art

With the development of electronic technologies, various types of devices have been developed and distributed, and particularly devices that perform speech synthesis are generalized.

The speech synthesis is a technology for realizing human voice from a text which is called text-to-speech (TTS), and in recent years, neural TTS using a neural network model is being developed.

The neural TTS, for example, may include a prosody neural network model and a neural vocoder neural network model. The prosody neural network model may receive a text and output acoustic feature information, and the neural vocoder neural network model may receive the acoustic feature information and output speech data (waveform).

In the TTS model, the prosody neural network model has an utterer's voice feature used in learning. In other words, the output of the prosody neural network model may be the acoustic feature information including a voice feature of a specific utterer and an utterance speed feature of the specific utterer.

In the related art, with the development of the artificial intelligence model, a personalized TTS model which outputs speech data including a voice feature of a user of an electronic device is proposed. The personalized TTS model is a TTS model that is trained based on utterance speech data of a personal user and outputs speech data including user's voice feature and utterance speed feature used in the learning.

Sound quality of the personal user's utterance speech data used in the training of the personalized TTS model is generally lower than sound quality of data used in the training of a general TTS model, and accordingly, a problem regarding the utterance speed for the speech data output from the personalized TTS model may occur.

Provided is an adaptive utterance speed adjustment method for a text-to-speech (TTS) model.

SUMMARY

Additional aspects will be set forth in part in the description which follows and, in part, will be apparent from the description, or may be learned by practice of the presented embodiments.

According to an aspect of an example embodiment, a method for controlling an electronic device may include obtaining a text, obtaining, by inputting the text into a first neural network model, acoustic feature information corresponding to the text and alignment information in which each frame of the acoustic feature information is matched with each phoneme included in the text, identifying an utterance speed of the acoustic feature information based on the alignment information, identifying a reference utterance speed for each phoneme included in the acoustic feature information based on the text and the acoustic feature information, obtaining utterance speed adjustment information based on the utterance speed of the acoustic feature information and the reference utterance speed for each phoneme, and obtaining, based on the utterance speed adjustment information, speech data corresponding to the text by inputting the acoustic feature information into a second neural network model.

The identifying the utterance speed of the acoustic feature information may include identifying an utterance speed corresponding to a first phoneme included in the acoustic feature information based on the alignment information. The identifying the reference utterance speed for each phoneme may include identifying the first phoneme included in the acoustic feature information based on the acoustic feature information and identifying a reference utterance speed corresponding to the first phoneme based on the text.

The identifying the reference utterance speed corresponding to the first phoneme may include obtaining a first reference utterance speed corresponding to the first phoneme based on the text and obtaining sample data used for training the first neural network model.

The identifying the reference utterance speed corresponding to the first phoneme may include obtaining evaluation information for the sample data used for training the first neural network model and identifying a second reference utterance speed corresponding to the first phoneme based on the first reference utterance speed corresponding to the first phoneme and the evaluation information. The evaluation information may be obtained by a user of the electronic device.

The method may include identifying the reference utterance speed corresponding to the first phoneme based on one of the first reference utterance speed and the second reference utterance speed.

The identifying the utterance speed corresponding to the first phoneme may include identifying an average utterance speed corresponding to the first phoneme based on the utterance speed corresponding to the first phoneme and an utterance speed corresponding to at least one phoneme before the first phoneme among the acoustic feature information. The obtaining the utterance speed adjustment information may include obtaining utterance speed adjustment information corresponding to the first phoneme based on the average utterance speed corresponding to the first phoneme and the reference utterance speed corresponding to the first phoneme.

The second neural network model may include an encoder configured to receive an input of the acoustic feature information and a decoder configured to receive an input of vector information output from the encoder. The obtaining the speech data may include while at least one frame corresponding to the first phoneme among the acoustic feature information is input to the second neural network model, identifying a number of loops of the decoder included in the second neural network model based on utterance speed adjustment information corresponding to the first phoneme and obtaining the at least one frame corresponding to the first phoneme and a number of pieces of first speech data, the number of pieces of first speech data corresponding to the number of loops, based on the input of the at least one frame corresponding to the first phoneme to the second neural network model. The first speech data may include speech data corresponding to the first phoneme.

Based on one of the at least one frame corresponding to the first phoneme among the acoustic feature information being input to the second neural network model, a number of pieces of second speech data may be obtained, the number of pieces of second speech data corresponding to the number of loops.

The decoder may be configured to obtain speech data at a first frequency based on acoustic feature information in which a shift size is a first time interval. Based on a value of the utterance speed adjustment information being a reference value, one frame included in the acoustic feature information is input to the second neural network model and a second number of pieces of speech data may be obtained, the second number of pieces of speech data corresponds to a product of the first time interval and the first frequency.

The utterance speed adjustment information may include information on a ratio value of the utterance speed of the acoustic feature information and the reference utterance speed of each phoneme.

According to an aspect of an example embodiment, an electronic device may include a memory configured to store instructions and a processor configured to execute the instructions to obtain a text, obtain, by inputting the text to a first neural network model, acoustic feature information corresponding to the text and alignment information in which each frame of the acoustic feature information is matched with each phoneme included in the text, identify an utterance speed of the acoustic feature information based on the alignment information, identify a reference utterance speed for each phoneme included in the acoustic feature information based on the text and the acoustic feature information, obtain utterance speed adjustment information based on the utterance speed of the acoustic feature information and the reference utterance speed for each phoneme, and obtain, based on the utterance speed adjustment information, speech data corresponding to the text by inputting the acoustic feature information to a second neural network model.

The processor may be further configured to execute the instructions to identify an utterance speed corresponding to a first phoneme included in the acoustic feature information based on the alignment information, identify the first phoneme included in the acoustic feature information based on the acoustic feature information, identify a reference utterance speed corresponding to the first phoneme based on the text.

The processor may be further configured to execute the instructions to obtain a first reference utterance speed corresponding to the first phoneme based on the text and obtain sample data used for training the first neural network model.

The processor may be further configured to execute the instructions to obtain evaluation information for the sample data used for training the first neural network model, and identify a second reference utterance speed corresponding to the first phoneme based on the first reference utterance speed corresponding to the first phoneme and the evaluation information. The evaluation information may be obtained by a user of the electronic device.

The processor may be further configured to execute the instructions to identify the reference utterance speed corresponding to the first phoneme based on one of the first reference utterance speed and the second reference utterance speed.

BRIEF DESCRIPTION OF THE DRAWINGS

The above and other aspects, features, and advantages of certain embodiments of the present disclosure will be more apparent from the following description taken in conjunction with the accompanying drawings, in which:

FIG. 7 is a mathematical expression for describing an embodiment in which the average utterance speed for each phoneme is identified through the exponential moving average (EMA) method according to an embodiment.

DETAILED DESCRIPTION

Hereinafter, the present disclosure will be described in detail with reference to the accompanying drawings.

Figure 1:
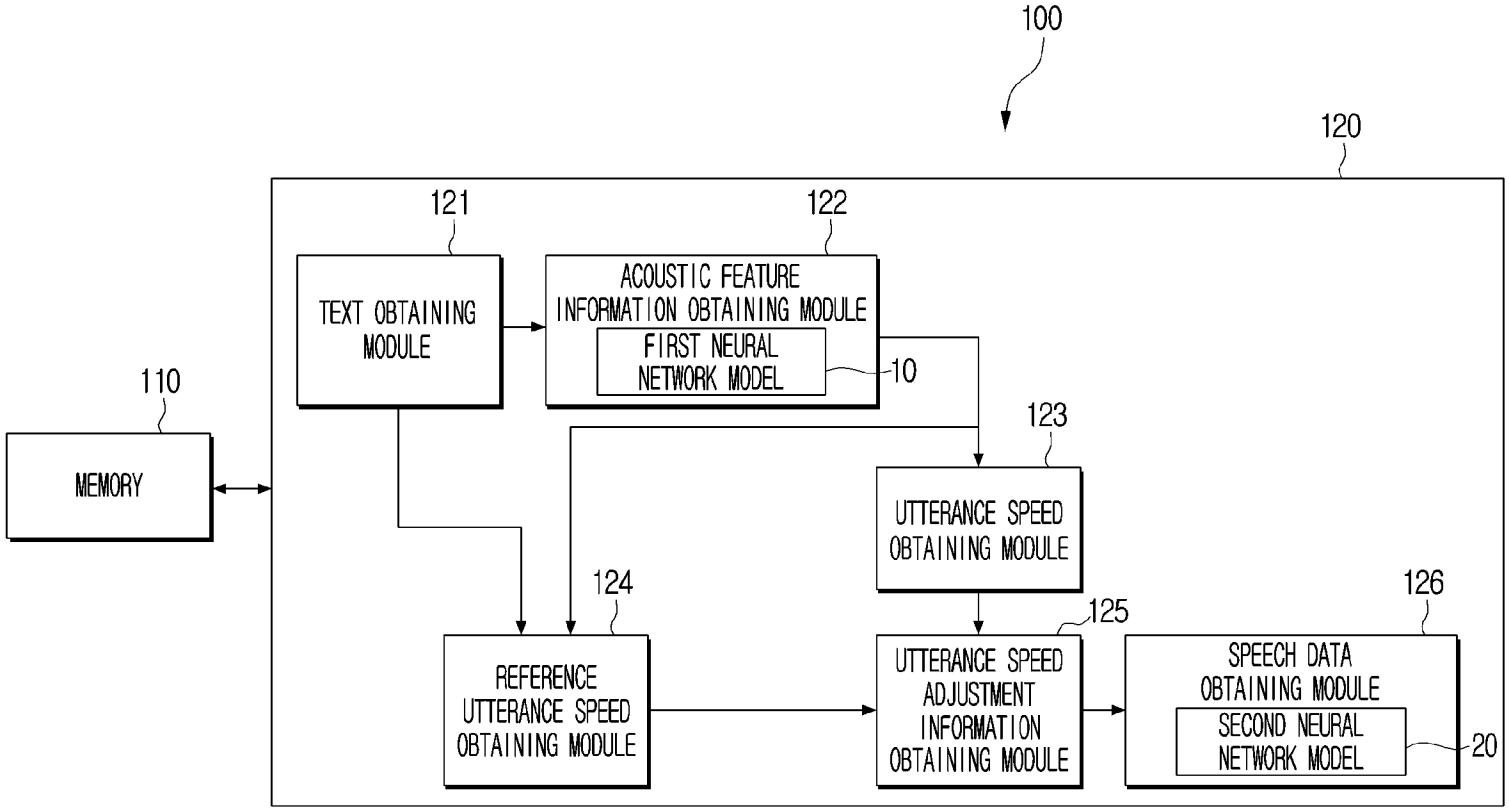
FIG. 1 is a block diagram illustrating a configuration of an electronic device according to an example embodiment.

FIG. 1 is a block diagram illustrating a configuration of an electronic device according to an example embodiment.

Referring to FIG. 1, an electronic device 100 may include a memory 110 and a processor 120. According to the disclosure, the electronic device 100 may be implemented as various types of electronic devices such as a smartphone, augmented reality (AR) glasses, a tablet personal computer (PC), a mobile phone, a video phone, an electronic book reader, a television (TV), a desktop PC, a laptop PC, a netbook computer, a work station, a camera, a smart watch, and a server.

The memory 110 may store at least one instruction or data regarding at least one of the other elements of the electronic device 100. Particularly, the memory 110 may be implemented as a non-volatile memory, a volatile memory, a flash memory, a hard disk drive (HDD) or a solid state drive (SDD). The memory 110 may be accessed by the processor 120, and perform readout, recording, correction, deletion, update, and the like, on data by the processor 120.

According the disclosure, the term, memory may include the memory 110, a read-only memory (ROM) and a random access memory (RAM) in the processor 120, and a memory card (not illustrated) attached to the electronic device 100 (e.g., micro secure digital (SD) card or memory stick).

As described above, the memory 110 may store at least one instruction. Herein, the instruction may be for controlling the electronic device 100. The memory 110 may store an instruction related to a function for changing an operation mode according to a dialogue situation of the user. Specifically, the memory 110 may include a plurality of constituent elements (or modules) for changing the operation mode according to the dialogue situation of the user according to the disclosure, and this will be described below.

The memory 110 may store data which is information in a bit or byte unit capable of representing characters, numbers, images, and the like. For example, the memory 110 may store a first neural network model 10 and a second neural network model 20. Herein, the first neural network model may be a prosody neural network model and the second neural network model may be a neural vocoder neural network model.

The processor 120 may be electrically connected to the memory 110 to control general operations and functions of the electronic device 100.

According to an embodiment, the processor 120 may be implemented as a digital signal processor (DSP), a microprocessor, a time controller (TCON), or the like. However, the processor is not limited thereto and may include one or more of a central processing unit (CPU), a microcontroller unit (MCU), a microprocessing unit (MPU), a controller, an application processor (AP), or a communication processor (CP), and an ARM processor or may be defined as the corresponding term. In addition, the processor 132 may be implemented as System on Chip (SoC) or large scale integration (LSI) including the processing algorithm or may be implemented in form of a field programmable gate array (FPGA).

One or a plurality of processors may perform control to process the input data according to a predefined action rule stored in the memory 110 or an artificial intelligence model. The predefined action rule or the artificial intelligence model is formed through training. Being formed through training herein may, for example, imply that a predefined action rule or an artificial intelligence model for a desired feature is formed by applying a learning algorithm to a plurality of pieces of learning data. Such training may be performed in a device demonstrating artificial intelligence according to the disclosure or performed by a separate server and/or system.

The artificial intelligence model may include a plurality of neural network layers. Each layer has a plurality of weight values, and executes operation of the layer through an operation result of a previous layer and operation between the plurality of weight values. Examples of the neural network may include convolutional neural network (CNN), a deep neural network (DNN), recurrent neural network (RNN), restricted Boltzmann machine (RBM), deep belief network (DBN), bidirectional recurrent deep neural network (BRDNN), and deep Q-network, but the neural network of the disclosure is not limited to the above examples, unless otherwise noted.

The processor 120 may, for example, control a number of hardware or software elements connected to the processor 120 by driving an operating system or application program, and perform various data processing and operations. In addition, the processor 120 may load and process a command or data received from at least one of the other elements to a non-volatile memory and store diverse data in a non-volatile memory.

Particularly, the processor 120 may provide an adaptive utterance speed adjustment function when synthesizing speech data. Referring to FIG. 1, the adaptive utterance speed adjustment function according to the disclosure may include a text obtaining module 121, an acoustic feature information obtaining module 122, an utterance speed obtaining module 123, a reference utterance speed obtaining module 124, an utterance speed adjustment information obtaining module 125, and a speech data obtaining module 126 and each module may be stored in the memory 110. In an example, the adaptive utterance speed adjustment function may adjust an utterance speed by adjusting the number of loops of the second neural network model 20 included in a text-to-speech (TTS) model 200 illustrated in FIG. 2.

Figure 2:
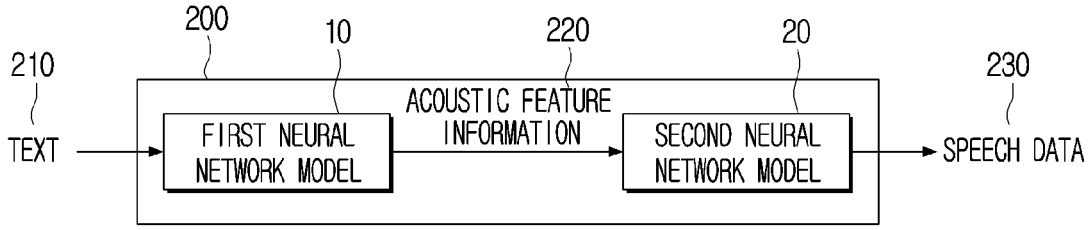
FIG. 2 is a block diagram illustrating a configuration of a text-to-speech (TTS) model according to an example embodiment.
Figure 3:
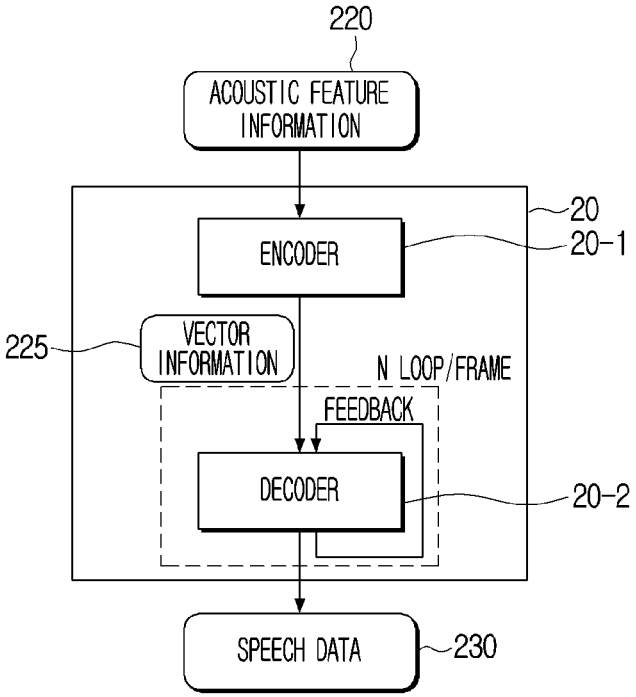
FIG. 3 is a block diagram illustrating a configuration of a neural network model in the TTS model according to an example embodiment.

FIG. 2 is a block diagram illustrating a configuration of a TTS model according to an example embodiment. FIG. 3 is a block diagram illustrating a configuration of a neural network model (e.g., a neural vocoder neural network model) in the TTS model according to an example embodiment.

The TTS model 200 illustrated in FIG. 2 may include the first neural network model 10 and the second neural network model 20.

The first neural network model 10 may be a constituent element for receiving a text 210 and outputting acoustic feature information 220 corresponding to the text 210. In an example, the first neural network model 10 may be implemented as a prosody neural network model.

The prosody neural network model may be a neural network model that has learned a relationship between a plurality of sample texts and a plurality of pieces of sample acoustic feature information corresponding to the plurality of sample texts, respectively. Specifically, the prosody neural network model may learn a relationship between one sample text and sample acoustic feature information obtained from sample speech data corresponding to the one sample text and perform such a process for the plurality of sample texts, thereby performing the learning of the prosody neural network model. In addition, in an example, the prosody neural network model may include a language processor for performance enhancement and the language processor may include a text normalization module, a phoneme conversion (Grapheme-to-Phoneme (G2P)) module, and the like. The acoustic feature information 220 output from the first neural network model 10 may include an utterer's voice feature used in the training of the first neural network model 10. In other words, the acoustic feature information 220 output from the first neural network model 10 may include a voice feature of a specific utterer (e.g., utterer corresponding to data used in the training of the first neural network model).

The second neural network model 20 is a neural network model for converting the acoustic feature information 220 into speech data 230 and may be implemented as a neural vocoder neural network model. According to the disclosure, the neural vocoder neural network model may receive the acoustic feature information 220 output from the first neural network model 10 and output the speech data 230 corresponding to the acoustic feature information 220. Specifically, the second neural network model 20 may be a neural network model which has learned a relationship between a plurality of pieces of sample acoustic feature information and sample speech data corresponding to each of the plurality of pieces of sample acoustic feature information.

In addition, referring to FIG. 3, the second neural network model 20 may include an encoder 20-1 which receives an input of the acoustic feature information 220 and a decoder 20-2 which receives an input of vector information output from the encoder 20-1 and outputs the speech data 230, and the second neural network model 20 will be described below with reference to FIG. 3.

Returning to FIG. 1, the plurality of modules 121 to 126 may be loaded to the memory (e.g., volatile memory) included in the processor 120 in order to perform the adaptive utterance speed adjustment function. In other words, in order to perform the adaptive utterance speed adjustment function, the processor 120 may execute functions of each of the plurality of modules 121 to 126 by loading the plurality of modules 121 to 126 to a volatile memory from a non-volatile memory. The loading may refer to an operation of calling data stored in a non-volatile memory to a volatile memory and storing the data therein so that the processor 120 is able to access it.

In an embodiment according to the disclosure, referring to FIG. 1, the adaptive utterance speed adjustment function may be implemented through the plurality of modules 121 to 126 stored in the memory 110, but there is no limitation thereto, and the adaptive utterance speed adjustment function may be implemented through an external device connected to the electronic device 100.

The plurality of modules 121 to 126 according to the disclosure may be implemented as each software, but there is no limitation thereto, and some modules may be implemented as a combination of hardware and software. In another embodiment, the plurality of modules 121 to 126 may be implemented as one software. In addition, some modules may be implemented in the electronic device 100 and other modules may be implemented in an external device.

The text obtaining module 121 may be a module for obtaining a text to be converted into speech data. In an example, the text obtained by the text obtaining module 121 may be a text corresponding to a response to a user's speech command. In an example, the text may be a text displayed on a display of the electronic device 100. In an example, the text may be a text input from a user of the electronic device 100. In an example, the text may be a text provided from a speech recognition system (e.g., Bixby). In an example, the text may be a text received from an external server. In other words, according to the disclosure, the text may be various texts to be converted into speech data.

The acoustic feature information obtaining module 122 may be a constituent element for obtaining acoustic feature information corresponding to the text obtained by the text obtaining module 121.

The acoustic feature information obtaining module 122 may input the text obtained by the text obtaining module 121 to the first neural network model 10 and output the acoustic feature information corresponding to the input text.

According to the disclosure, the acoustic feature information may be information including information on voice features (e.g., intonation information, cadence information, and utterance speed information) of a specific utterer. Such acoustic feature information may be input to the second neural network model 20 which will be described below, thereby outputting speech data corresponding to the text.

Herein, the acoustic feature information may refer to a silent feature within a short section (e.g., a frame) of the speech data, and the acoustic feature information for each section may be obtained after short-time analysis of the speech data. The frame of the acoustic feature information may be set to 10 to 20 msec, but may be set to any other time sections. Examples of the acoustic feature information may include Spectrum, Mel-spectrum, Cepstrum, pitch lag, pitch correlation, and the like and one or a combination of these may be used.

For example, the acoustic feature information may be set by a method of 257-dimensional Spectrum, 80-dimensional Mel-spectrum, or Cepstrum (20 dimensions)+pitch lag (one dimension)+pitch correlation (one dimension). More specifically, for example, in a case where a shift size is 10 msec and 80-dimensional Mel-spectrum is used as the acoustic feature information, [100,80]-dimensional acoustic feature information may be obtained from speech data for 1 second, and [T,D] herein may contain the following meaning.

[T,D]: T frames, D-dimensional acoustic feature information.

In addition, the acoustic feature information obtaining module 122 may obtain alignment information in which each frame of the acoustic feature information output from the first neural network model 10 is matched with each phoneme included in the input text. Specifically, the acoustic feature information obtaining module 122 may obtain acoustic feature information corresponding to the text by inputting the text to the first neural network model 10, and obtain alignment information in which each frame of the acoustic feature information is matched with each phoneme included in the text input to the first neural network model 10.

According to the disclosure, the alignment information may be matrix information for alignment between input/output sequences on a sequence-to-sequence model. Specifically, information regarding from which input each time-step of the output sequence is predicted may be obtained through the alignment information. In addition, according to the disclosure, the alignment information obtained by the first neural network model 10 may be alignment information in which a "phoneme" corresponding to a text input to the first neural network model 10 is matched with a "frame of acoustic feature information" output from the first neural network model 10, and the alignment information will be described below with reference to FIG. 5.

The utterance speed obtaining module 123 is a constituent element for identifying an utterance speed of the acoustic feature information obtained from the acoustic feature information obtaining module 122 based on the alignment information obtained from the acoustic feature information obtaining module 122.

The utterance speed obtaining module 123 may identify an utterance speed corresponding to each phoneme included in the acoustic feature information obtained from the acoustic feature information obtaining module 122 based on the alignment information obtained from the acoustic feature information obtaining module 122.

Specifically, the utterance speed obtaining module 123 may identify the utterance speed of each phoneme included in the acoustic feature information obtained from the acoustic feature information obtaining module 122 based on the alignment information obtained from the acoustic feature information obtaining module 122. According to the disclosure, since the alignment information is alignment information in which the "phoneme" corresponding to the text input to the first neural network model 10 is matched with the "frame of the acoustic feature information" output from the first neural network model 10, it is found that, as the number of frames of the acoustic feature information corresponding to a first phoneme among phonemes included in the alignment information is large, the first phoneme is uttered slowly. In an example, when the number of frames of the acoustic feature information corresponding to the first phoneme is identified as three and the number of frames of the acoustic feature information corresponding to a second phoneme is identified as five based on the alignment information, it is found that the utterance speed of the first phoneme is relatively higher than the utterance speed of the second phoneme.

When the utterance speed of each phoneme included in the text is obtained, the utterance speed obtaining module 123 may obtain an average utterance speed of a specific phoneme in consideration of utterance speeds corresponding to the specific phoneme and at least one phoneme before the corresponding phoneme included in the text. In an example, the utterance speed obtaining module 123 may identify an average utterance speed corresponding to the first phoneme based on an utterance speed corresponding to the first phoneme included in the text and an utterance speed corresponding to each of at least one phoneme.

However, since the utterance speed of one phoneme is a speed of a short section, a length difference between phonemes may be reduced when predicting the utterance speed of an extremely short section, thereby generating an unnatural result. In addition, when predicting the utterance speed of the extremely short section, an utterance speed prediction value excessively rapidly changes on a time axis, thereby generating an unnatural result. Accordingly, in the disclosure, an average utterance speed corresponding to phonemes considering with utterance speeds of phonemes before the phoneme may be identified, and the identified average utterance speed may be used as the utterance speed of the corresponding phoneme.

However, when predicting the average utterance speed for an extremely long section in the utterance speed prediction, it is difficult to reflect if slow utterance and fast utterance are in the text together. In addition, in a streaming structure, it is the speed prediction for the utterance of which the identified utterance speed is already output, accordingly, a delay for the utterance speed adjustment may occur, and therefore, it is necessary to provide a method for measuring an average utterance speed for an appropriate section.

According to an embodiment, the average utterance speed may be identified by a simple moving average method or an exponential moving average (EMA) method, and this will be described in detail below with reference to FIGS. 6 and 7.

The reference utterance speed obtaining module 124 is a constituent element for identifying a reference utterance speed for each phoneme included in the acoustic feature information. According to the disclosure, the reference utterance speed may refer to an optimal utterance speed felt as an appropriate speed for each phoneme included in the acoustic feature information.

In a first embodiment, the reference utterance speed obtaining module 124 may obtain a first reference utterance speed corresponding to the first phoneme included in the acoustic feature information based on sample data (e.g., sample text and sample speech data) used for the training of the first neural network model 10.

In an example, when the number of vowels is large in a phoneme ring including the first phoneme, the first reference utterance speed corresponding to the first phoneme may be relatively slow. In addition, when the number of consonants is large in the phoneme ring including the first phoneme, the first reference utterance speed corresponding to the first phoneme may be relatively fast. Further, when a word including the first phoneme is a word to be emphasized, the corresponding word will be uttered slowly, and accordingly, the first reference utterance speed corresponding to the first phoneme may be relatively slow.

In an example, the reference utterance speed obtaining module 124 may obtain the first reference utterance speed corresponding to the first phoneme using a third neural network model which estimates a reference utterance speed. Specifically, the reference utterance speed obtaining module 124 may identify the first phoneme from the alignment information obtained from the acoustic feature information obtaining module 122. In addition, the reference utterance speed obtaining module 124 may obtain the first reference utterance speed corresponding to the first phoneme by inputting the information on the identified first phoneme and the text obtained from the text obtaining module 121 to the third neural network model.

In an example, the third neural network model may be trained based on sample data (e.g., sample text and sample speech data) used in the training of the first neural network model 10. In other words, the third neural network model may be trained to estimate a section average utterance speed of sample acoustic feature information based on the sample acoustic feature information and a sample text corresponding to the sample acoustic feature information. Herein, the third neural network model may be implemented as a statistic model such as a Hidden Markov Model (HMM) and a DNN capable of estimating the section average utterance speed. The data used for training the third neural network model will be described below with reference to FIG. 8.

In the embodiment described above, it is described that the first reference utterance speed corresponding to the first phoneme is obtained using the third neural network model, but the disclosure is not limited thereto. In other words, the reference utterance speed obtaining module 124 may obtain the first reference utterance speed corresponding to the first phoneme using a rule-based prediction method or a decision-based prediction method, other than the third neural network.

In a second embodiment, the reference utterance speed obtaining module 124 may obtain a second reference utterance speed which is an utterance speed subjectively determined by a user who listens the speech data. Specifically, the reference utterance speed obtaining module 124 may obtain evaluation information for the sample data used in the training of the first neural network model 10. In an example, the reference utterance speed obtaining module 124 may obtain evaluation information of the user for the sample speech data used in the training of the first neural network model 10. Herein, the evaluation information may be evaluation information for a speed subjectively felt by the user who listened the sample speech data. In an example, the evaluation information may be obtained by receiving a user input through a UI displayed on the display of the electronic device 100.

In an example, if the user who listened the sample speech data felt that the utterance speed of the sample speech data is slightly slow, the reference utterance speed obtaining module 124 may obtain first evaluation information for setting the utterance speed of the sample speech data faster (e.g., 1.1 times) from the user. In an example, if the user who listened the sample speech data felt that the utterance speed of the sample speech data is slightly fast, the reference utterance speed obtaining module 124 may obtain second evaluation information for setting the utterance speed of the sample speech data slower (e.g., 0.95 times) from the user.

In addition, the reference utterance speed obtaining module 124 may obtain the second reference utterance speed obtained by applying the evaluation information to the first reference utterance speed corresponding to the first phoneme. In an example, when the first evaluation information is obtained, the reference utterance speed obtaining module 124 may identify an utterance speed corresponding to 1.1 times the first reference utterance speed corresponding to the first phoneme as the second reference utterance speed corresponding to the first phoneme. In an example, when the second evaluation information is obtained, the reference utterance speed obtaining module 124 may identify an utterance speed corresponding to 0.95 times the first reference utterance speed corresponding to the first phoneme as the second reference utterance speed corresponding to the first phoneme.

In a third embodiment, the reference utterance speed obtaining module 124 may obtain a third reference utterance speed based on evaluation information for reference sample data. Herein, the reference sample data may include a plurality of sample texts and a plurality of pieces of sample speech data obtained by uttering each of the plurality of sample texts by a reference utterer. In an example, the first reference sample data may include a plurality of sample speech data obtained by uttering each of the plurality of sample texts by a specific voice actor, and the second reference sample data may include a plurality of sample speech data obtained by uttering each of the plurality of sample texts by another voice actor. In addition, the reference utterance speed obtaining module 124 may obtain the third reference utterance speed based on evaluation information of the user for reference sample data. In an example, when the first evaluation information is obtained for the first reference sample data, the reference utterance speed obtaining module 124 may identify a speed which is 1.1 times the utterance speed of the first phoneme corresponding to the first reference sample data as the third reference utterance speed corresponding to the first phoneme. In an example, when the second evaluation information is obtained for the first reference sample data, the reference utterance speed obtaining module 124 may identify a speed which is 0.95 times the utterance speed of the first phoneme corresponding to the first reference sample data as the third reference utterance speed corresponding to the first phoneme.

In addition, the reference utterance speed obtaining module 124 may identify one of the first reference utterance speed corresponding to the first phoneme, the second reference utterance speed corresponding to the first phoneme, and the third reference utterance speed corresponding to the first phoneme as the reference utterance speed corresponding to the first phoneme.

The utterance speed adjustment information obtaining module 125 is a constituent element for obtaining utterance speed adjustment information based on the utterance speed corresponding to the first phoneme obtained through the utterance speed obtaining module 123 and the utterance speed corresponding to the first phoneme obtained through the reference utterance speed obtaining module 124.

Specifically, when an utterance speed corresponding to an n-th phoneme obtained through the utterance speed obtaining module 123 is defined as Xn, and a reference utterance speed corresponding to the n-th phoneme obtained through the reference utterance speed obtaining module 124 is defined as Xrefn, the utterance speed adjustment information Sn corresponding to the n-th phoneme may be defined as (Xrefn/Xn). In an example, when a currently predicted utterance speed X1 corresponding to the first phoneme is 20 (phoneme/sec) and the reference utterance speed Xref1 corresponding to the first phoneme is 18 (phoneme/sec), the utterance speed adjustment information 51 corresponding to the first phoneme may be 0.9.

The speech data obtaining module 126 is a constituent element for obtaining the speech data corresponding to the text.

Specifically, the speech data obtaining module 126 may obtain speech data corresponding to the text by inputting acoustic feature information corresponding to the text obtained from the acoustic feature information obtaining module 122 to the second neural network model 20 set based on the utterance speed adjustment information.

While at least one frame corresponding to the first phoneme among the acoustic feature information 220 is input to the second neural network model 20, the speech data obtaining module 126 may identify the number of loops of the decoder 20-2 in the second neural network model 20 based on the utterance speed adjustment information corresponding to the first phoneme. In addition, the speech data obtaining module 126 may obtain a plurality of pieces of first speech data corresponding to the number of loops from the decoder 20-2 while the at least one frame corresponding to the first phoneme is input to the second neural network model 20.

When one of the at least one frame corresponding to the first phoneme among the acoustic feature information is input to the second neural network model 20, a plurality of pieces of second speech sample data, the number of which corresponds to the number of loops, may be obtained. In addition, a set of the second speech sample data obtained by inputting each of the at least one frame corresponding to the first phoneme to the second neural network model 20 may be first speech data. Herein, the plurality of pieces of first speech data may be speech data corresponding to the first phoneme.

In other words, the number of samples of the speech data to be output may be adjusted by adjusting the number of loops of the decoder 20-2, and accordingly, the utterance speed of the speech data may be adjusted by adjusting the number of loops of the decoder 20-2. The utterance speed adjustment method through the second neural network model 20 will be described below with reference to FIG. 3.

The speech data obtaining module 126 may obtain speech data corresponding to the text by inputting each of the plurality of phonemes included in the acoustic feature information to the second neural network model 20 in which the number of loops of the decoder 20-2 is set based on the utterance speed adjustment information corresponding to each of the plurality of phonemes.

Referring to FIG. 3, the encoder 20-1 of the second neural network model 20 may receive the acoustic feature information 220 and output vector information 225 corresponding to the acoustic feature information 220. Herein, the vector information 225 is data output from a hidden layer from a viewpoint of the second neural network model 20 and may be called hidden representation accordingly.

While at least one frame corresponding to the first phoneme among the acoustic feature information 220 is input to the second neural network model 20, the speech data obtaining module 126 may identify the number of loops of the decoder 20-2 based on the utterance speed adjustment information corresponding to the first phoneme. In addition, the speech data obtaining module 126 may obtain a plurality of pieces of first speech data corresponding to the number of loops identified from the decoder 20-2 while the at least one frame corresponding to the first phoneme is input to the second neural network model 20.

In other words, when one of the at least one frame corresponding to the first phoneme among the acoustic feature information is input to the second neural network model 20, a plurality of pieces of second speech sample data, the number of which corresponds to the number of loops, may be obtained. In an example, when one of the at least one frame corresponding to the first phoneme among the acoustic feature information 220 is input to the encoder 20-1 of the second neural network model 20, vector information corresponding thereto may be output. In addition, the vector information is input to the decoder 20-2 and the decoder 20-2 may operate with N number of loops, that is, N number of loops per one frame of the acoustic feature information 220 and output N pieces of speech data.

In addition, a set of the second speech data obtained by inputting each of the at least one frame corresponding to the first phoneme to the second neural network model 20 may be first speech data. Herein, the plurality of pieces of first speech data may be speech data corresponding to the first phoneme.

In an embodiment in which speech data at a first frequency (khz) is obtained from the decoder 20-2 based on acoustic feature information in which a shift size is a first time interval (sec), when a value of the utterance speed adjustment information is a reference value (e.g., 1), one frame included in the acoustic feature information is input to the second neural network model 20, and the decoder 20-2 may operate with the number of loops corresponding to (first time interval X first frequency), thereby obtaining the speech data, the number of which corresponds to the corresponding number of loops. In an example, when obtaining speech data at 24 khz from the decoder 20-2 based on acoustic feature information in which the shift size is 10 msec, when the value of the utterance speed adjustment information is a reference value (e.g., 1), one frame included in the acoustic feature information is input to the second neural network model 20, and the decoder 20-2 may operate with 240 loops, thereby obtaining 240 speech data.

In addition, in an embodiment in which speech data at a first frequency is obtained from the decoder 20-2 based on acoustic feature information in which a shift size is a first time interval, one frame included in the acoustic feature information is input to the second neural network model 20, and the decoder 20-2 may operate with the number of loops corresponding to the product of the first time interval, the first frequency and the utterance speed adjustment information, thereby obtaining the speech data, the number of speech data corresponding to the corresponding number of loops. In an example, when obtaining speech data at 24 khz from the decoder 20-2 based on acoustic feature information in which the shift size is 10 msec, when the value of the utterance speed adjustment information is a reference value (e.g., 1.1), one frame included in the acoustic feature information is input to the second neural network model 20, and the decoder 20-2 may operate with 264 loops, thereby obtaining 264 speech data.

Herein, the number of speech data obtained when the value of the utterance speed adjustment information is 1.1 (e.g., 264) may be larger than the number of speech data obtained when the value of the utterance speed adjustment information is the reference value (e.g., 240). In other words, when the value of the utterance speed adjustment information is adjusted to 1.1, the speech data corresponding to the previous shift value of 10 msec is output for 11 msec, and accordingly, the utterance speed may be adjusted to be slower compared to a case where the value of the utterance speed adjustment information is the reference value.

In other words, when the reference value of the utterance speed adjustment information is 1, if the value of the utterance speed adjustment information is defined as S, the number of loops N' of the decoder 20-2 may be as in Equation (1).

$$N'_n = N \times \frac{1}{S_n} \tag{1}$$

In Equation (1), $N'_n$ may represent the number of loops of the decoder 20-2 for utterance speed adjustment in an n-th phoneme and A may represent the reference number of loops of the decoder 20-2. In addition, $S_n$ in the n-th phoneme is a value of the utterance speed adjustment information, and accordingly, when $S_n$ is 1.1, speech data uttered 10% faster may be obtained.

Further, as shown in Equation (1), the utterance speed adjustment information may be set differently for each phoneme included in the acoustic feature information 220 input to the second neural network model 20. In other words, in the disclosure, based on Equation (1), speech data with the utterance speed adjusted in real time may be obtained by using the adaptive utterance speed adjustment method for adjusting the utterance speed differently for each phoneme included in the acoustic feature information 220.

Figure 4:
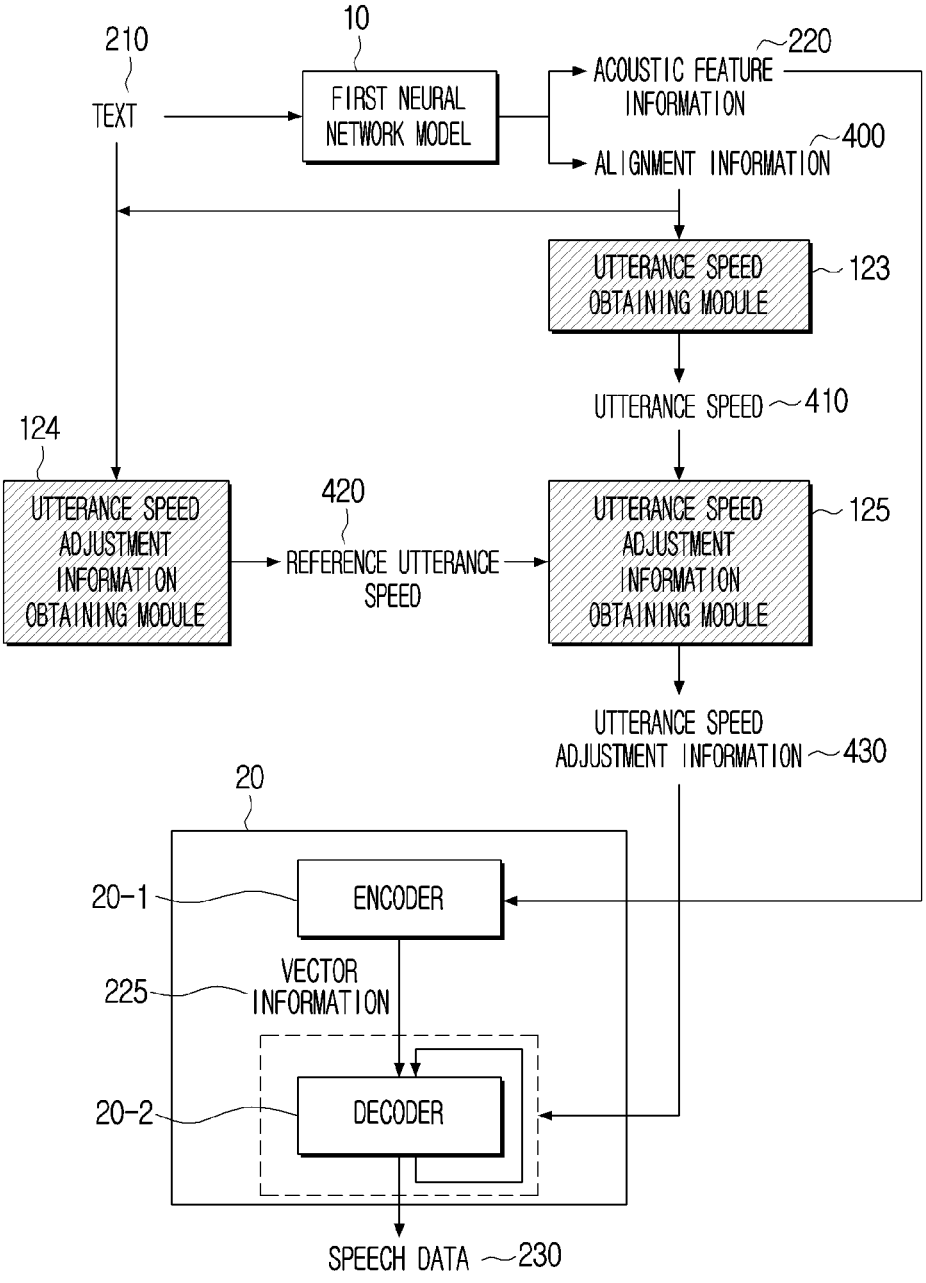
FIG. 4 is a diagram illustrating a method for obtaining speech data with an improved utterance speed according to an example embodiment.

FIG. 4 is a diagram illustrating a method for obtaining speech data with an improved utterance speed by the electronic device according to an example embodiment.

Referring to FIG. 4, the electronic device 100 may obtain the text 210. Herein, the text 210 is a text to be converted into speech data and a method for obtaining the text is not limited. In other words, the text 210 may include various texts such as a text input from the user of the electronic device 100, a text provided from a speech recognition system (e.g., Bixby) of the electronic device 100, and a text received from an external server.

In addition, the electronic device 100 may obtain the acoustic feature information 220 and alignment information 400 by inputting the text 210 to the first neural network model 10. Herein, the acoustic feature information 220 may be information including a voice feature and an utterance speed feature corresponding to the text 210 of a specific utterer (e.g., specific utterer corresponding to the first neural network model). The alignment information 400 may be alignment information in which the phoneme included in the text 210 is matched with each frame of the acoustic feature information 220.

In addition, the electronic device 100 may obtain an utterance speed 410 corresponding to the acoustic feature information 220 based on the alignment information 400 through the utterance speed obtaining module 123. Herein, the utterance speed 410 may be information on actual utterance speed, in a case where the acoustic feature information 220 is converted into the speech data 230. In addition, the utterance speed 410 may include utterance speed information for each phoneme included in the acoustic feature information 220.

In addition, the electronic device 100 may obtain a reference utterance speed 420 based on the text 210 and the alignment information 400 through the utterance speed adjustment information obtaining module 125. Herein, the reference utterance speed 420 may refer to an optimal utterance speed for the phoneme included in the text 210. In addition, the reference utterance speed 420 may include reference utterance speed information for each phoneme included in the acoustic feature information 220.

In addition, the electronic device 100 may obtain utterance speed adjustment information 430 based on the utterance speed 410 and the reference utterance speed 420 through the utterance speed adjustment information obtaining module 125. Herein, the utterance speed adjustment information 430 may be information for adjusting the utterance speed of each phoneme included in the acoustic feature information 220. For example, if the utterance speed 410 of an m-th phoneme is 20 (phoneme/sec) and the reference utterance speed 420 of the m-th phoneme is 18 (phoneme/sec), the utterance speed adjustment information 430 for the m-th phoneme may be identified as 0.9 (18/20).

In addition, the electronic device 100 may obtain the speech data 230 corresponding to the text 210 by inputting the acoustic feature information 220 to the second neural network model 20 set based on the utterance speed adjustment information 430.

In an embodiment, while at least one frame corresponding to the m-th phoneme among the acoustic feature information 220 is input to the encoder 20-1 of the second neural network model 20, the electronic device 100 may identify the number of loops of the decoder 20-2 of the second neural network model 20 based on the utterance speed adjustment information 430 corresponding to the m-th phoneme. In an example, when the utterance speed adjustment information 430 for the m-th phoneme is 0.9, the number of loops of the decoder 20-2 while the frame corresponding to the m-th phoneme among the acoustic feature information 220 is input to the encoder 20-1 may be (utterance speed adjustment information corresponding to basic number of loops/m-th phoneme). In other words, if the basic number of loops is 240 times, the number of loops of the decoder 20-2 while the frame corresponding to the m-th phoneme among the acoustic feature information 220 is input to the encoder 20-1 may be 264 times.

When the number of loops is identified, the electronic device 100 may operate the decoder 20-2 by the number of loops corresponding to the m-th phoneme, while the frame corresponding to the m-th phoneme is input to the decoder 20-2 among the acoustic feature information 220, and obtain pieces of speech data corresponding to the number of loops corresponding to the m-th phoneme per frame of the acoustic feature information 220. In addition, the electronic device 100 may obtain the speech data 230 corresponding to the text 210 by performing such a process with respect to all phonemes included in the text 210.

Figure 5:
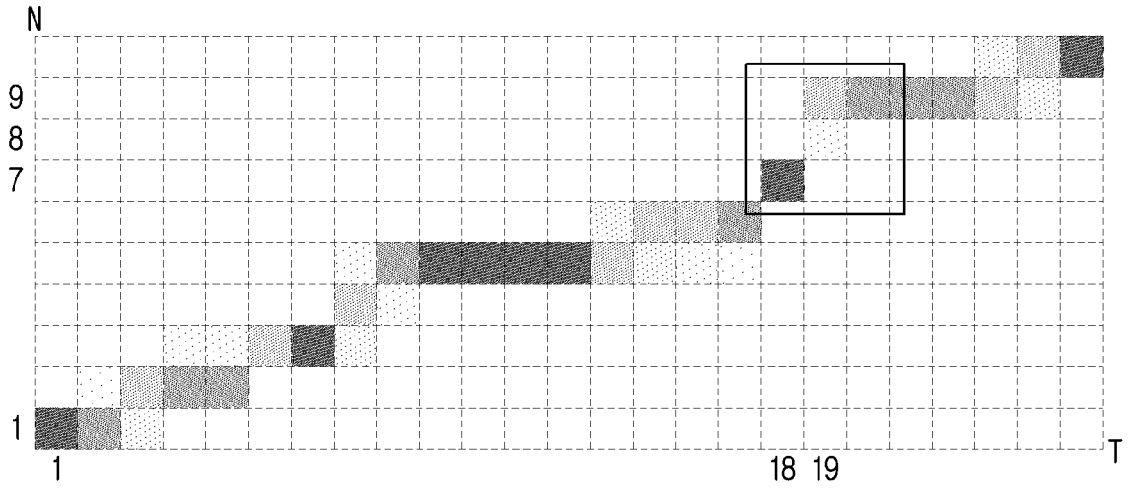
FIG. 5 is a diagram illustrating alignment information in which each frame of acoustic feature information is matched with each phoneme included in a text according to an example embodiment.

FIG. 5 is a diagram illustrating alignment information in which each frame of acoustic feature information is matched with each phoneme included in a text according to an example embodiment.

Referring to FIG. 5, the alignment information in which each frame of the acoustic feature information is matched with each phoneme included in the text may have a size of (N,T). Herein, N may represent the number of all phonemes included in the text 210 and T may represent the number of frames of the acoustic feature information 220 corresponding to the text 210.

When $A_{n,t}$ is defined as a weight at an n-th phoneme and a t-th frame from the acoustic feature information 220, $\Sigma_n A_{n,t}=1$ may be satisfied.

The phoneme $P_t$ mapped with the t-th frame in the alignment information may be as Equation (2).

$$P_t = \underset{n}{\operatorname{argmax}} A_{n,i} \tag{2}$$

In other words, referring to Equation (2), the phoneme $P_t$ mapped with the t-th frame may be a phoneme having the largest value of $A_{n,t}$ corresponding to the t-th frame.

A length of the phoneme corresponding to $P_t$ among frames of $P_t=n\neq P_{t+1}=n+1$ may be identified. In other words, when the length of the n-th phoneme is defined as $d_n$, the length of the n-th phoneme may be the same as in Equation (3).

$$d_n=t-\Sigma_{n=1}^{n-1}d_k \tag{3}$$

In other words, referring to Equation (3), $d_1$ of the alignment information of FIG. 5 may be 2 and $d_2$ may be 3.

Phonemes not mapped as max value may exist as in a square area of FIG. 5. In an example, special symbols may be used for the phoneme in the TTS model using the first neural network model 10, and in this case, the special symbols may generate pause, but may affect only front and back prosody and may not be actually uttered. In such a case, phonemes not mapped with the frame may exist as in the square area of FIG. 5.

In this case, the length of phoneme not mapped $d_n$ may be allocated as in Equation (4). In other words, among the frames of $P_t=n\neq P_{t+1}=n+\delta$, the length from n-th to $n+\delta-1$-th phonemes may be in Equation (4). Herein, $\delta$ may be a value larger than 1.

$$d_n=d_{n+1}=\ldots=d_{n+\delta-1}=(t-\Sigma_{k=1}^{n-1}d_k)/\delta \tag{4}$$

Referring to Equation (4), $d_7$ of the alignment information of FIG. 5 may be 0.5 and $d_8$ may be 0.5.

As described above, through the alignment information, the length of the phoneme included in the acoustic feature information 220 may be identified and the utterance speed for each phoneme may be identified through the length of the phoneme.

Specifically, the utterance speed $x_n$ of the n-th phoneme included in the acoustic feature information 220 may be as in Equation (5).

$$x_n = \frac{1}{d_n} \times \frac{1}{r} \times \frac{1}{\text{frame-length(sec)}} \tag{5}$$

In Equation (5), r may be a reduction factor of the first neural network model 10. In an example, when r is 1 and the frame-length is 10 ms, $x_1$ may be 50 and $x_7$ may be 33.3.

However, since the utterance speed of one phoneme is a speed of a short section, a length difference between phonemes may be reduced when predicting the utterance speed of an extremely short section, thereby generating an unnatural result. In addition, when predicting the utterance speed of the extremely short section, an utterance speed prediction value excessively rapidly changes on a time axis, thereby generating an unnatural result. In addition, when predicting the average utterance speed for an extremely long section in the utterance speed prediction, it is difficult to reflect if slow utterance and fast utterance are in the text together. In addition, in a streaming structure, it is the speed prediction for the utterance of which the identified utterance speed is already output, accordingly, a delay for the utterance speed adjustment may occur, and therefore, it is necessary to provide a method for measuring an average utterance speed for an appropriate section, and this will be described below with reference to FIGS. 6 and 7.

Figure 6:
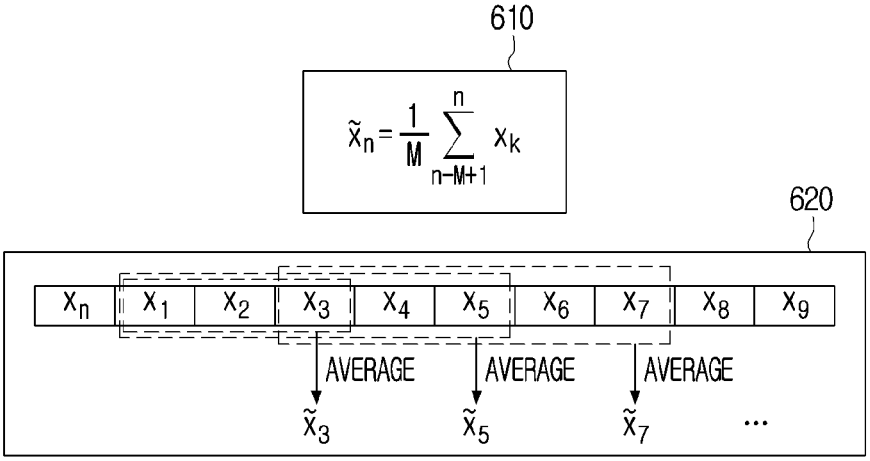
FIG. 6 is a diagram illustrating a method for identifying a reference utterance speed for each phoneme included in acoustic feature information according to an example embodiment.

FIG. 6 is a diagram illustrating a method for identifying an average utterance speed for each phoneme included in acoustic feature information according to an example embodiment.

Referring to an embodiment 610 of FIG. 6, the electronic device 100 may calculate an average of the utterance speed for recent M phonemes included in the acoustic feature information 220. In an example, if n<M, the average utterance speed may be calculated by averaging only corresponding elements.

In addition, when M is 5, as in an embodiment 620 of FIG. 6, the average utterance speed $\tilde{x}_3$ of a third phoneme may be calculated as an average value of $x_1$, $x_2$, and $x_3$. In addition, the average utterance speed $\tilde{x}_5$ of a fifth phoneme may be calculated as an average value of $x_1$ to $x_5$.

The method for calculating the average utterance speed for each phoneme through the embodiment 610 and the embodiment 620 of FIG. 6 may refer to a simple moving average method.

FIG. 7 is a mathematical expression for describing an embodiment in which the average utterance speed for each phoneme is identified through the exponential moving average (EMA) method according to an embodiment.

In other words, according to the EMA method as the mathematical expression of FIG. 7, the weight is exponentially reduced as it is the utterance speed for a phoneme far from the current phoneme, and therefore, an average length of a suitable section may be calculated.

Herein, as a value of a of FIG. 7 is large, an average utterance speed for a short section may be calculated, and as the value of a is small, an average utterance speed for a long section may be calculated. Therefore, the electronic device 100 may calculate the current average utterance speed in real time by selecting the suitable value of a according to the situation.

Figure 8:
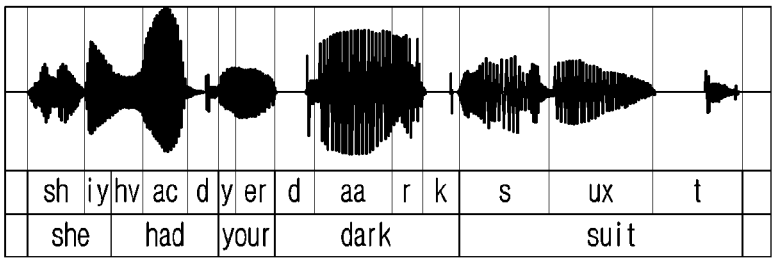
FIG. 8 is a diagram illustrating a method for identifying a reference utterance speed according to an example embodiment.

FIG. 8 is a diagram illustrating a method for identifying a reference utterance speed according to an embodiment.

FIG. 8 is a diagram illustrating a method for training the third neural network model which obtains the reference utterance speed corresponding to each phoneme included in the acoustic feature information 220 according to an embodiment.

In an example, the third neural network model may be trained based on sample data (e.g., sample text and sample speech data). In an example, the sample data may be sample data used in the training of the first neural network model 10.

The acoustic feature information corresponding to the sample speech data may be extracted based on the sample speech data and the utterance speed for each phoneme included in the sample speech data may be identified as in FIG. 8. In addition, the third neural network model may be trained based on the sample text and the utterance speed for each phoneme included in the sample speech data.

In other words, the third neural network model may be trained to estimate a section average utterance speed of sample acoustic feature information based on the sample acoustic feature information and a sample text corresponding to the sample acoustic feature information. Herein, the third neural network model may be implemented as a statistic model such as a HMM and a DNN capable of estimating the section average utterance speed.

The electronic device 100 may identify the reference utterance speed for each phoneme included in the acoustic feature information 220 by using the trained third neural network model, the text 210, and the alignment information 400.

Figure 9:
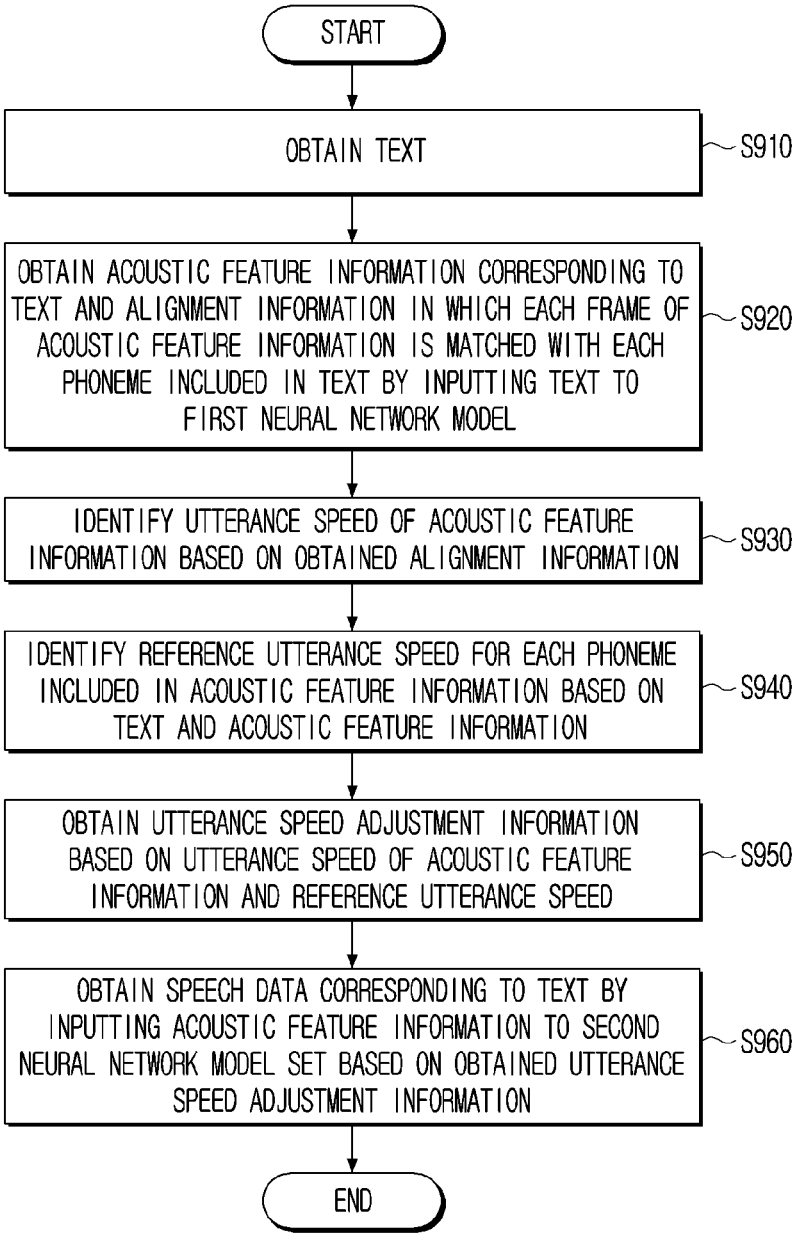
FIG. 9 is a flowchart illustrating an operation of the electronic device according to an example embodiment.

FIG. 9 is a flowchart illustrating an operation of the electronic device according to an embodiment.

Referring to FIG. 9, in operation S910, the electronic device 100 may obtain a text. Herein, the text may include various texts such as a text input from the user of the electronic device 100, a text provided from a speech recognition system (e.g., Bixby) of the electronic device, and a text received from an external server.

In addition, in operation S920, the electronic device 100 may obtain acoustic feature information corresponding to the text and alignment information in which each frame of the acoustic feature information is matched with each phoneme included in the text by inputting the text to the first neural network model. In an example, the alignment information may be matrix information having a size of (N,T), as illustrated in FIG. 5.

In operation S930, the electronic device 100 may identify the utterance speed of the acoustic feature information based on the obtained alignment information. Specifically, the electronic device 100 may identify the utterance speed for each phoneme included in the acoustic feature information based on the obtained alignment information. Herein, the utterance speed for each phoneme may be an utterance speed corresponding to one phoneme but is not limited thereto. In other words, the utterance speed for each phoneme may be an average utterance speed obtained by further considering an utterance speed corresponding to each of at least one phoneme before the corresponding phoneme.

In addition, in operation S940, the electronic device 100 may identify a reference utterance speed for each phoneme included in the acoustic feature information based on the text and the acoustic feature information. Herein, the reference utterance speed may be identified by various methods as described with reference to FIG. 1.

In an example, the electronic device 100 may obtain a first reference utterance speed for each phoneme included in the acoustic feature information based on obtained text and sample data used in the training of the first neural network.

In an example, the electronic device 100 may obtain evaluation information for the sample data used in the training of the first neural network model. In an example, the electronic device 100 may provide the speech data among the sample data to the user and then receive an input of evaluation information for a feedback thereof. The electronic device 100 may obtain a second reference utterance speed for each phoneme included in the acoustic feature information based on the first reference utterance speed and the evaluation information.

The electronic device 100 may identify a reference utterance speed for each phoneme included in the acoustic feature information based on at least one of the first reference utterance speed and the second reference utterance speed.

In operation S950, the electronic device 100 may obtain the utterance speed adjustment information based on the utterance speed of the acoustic feature information and the reference utterance speed. Specifically, when an utterance speed corresponding to an n-th phoneme is defined as Xn, and a reference utterance speed corresponding to the n-th phoneme is defined as Xrefn, the utterance speed adjustment information Sn corresponding to the n-th phoneme may be defined as (Xrefn/Xn).

The electronic device 100 may obtain the speech data corresponding to the text by inputting the acoustic feature information to the second neural network model set based on the obtained utterance speed adjustment information (S960).

Specifically, the second neural network model may include an encoder which receives an input of the acoustic feature information and a decoder which receives an input of vector information output from the encoder and outputs speech data. While at least one frame corresponding to a specific phoneme included in the acoustic feature information is input to the second neural network model, the electronic device 100 may identify the number of loops of the decoder included in the second neural network model based on the utterance speed adjustment information corresponding to the corresponding phoneme. The electronic device 100 may obtain the first speech data corresponding to the number of loops by operating the decoder by the identified number of loops based on the input of at least one frame corresponding to the corresponding phoneme to the second neural network model.

Specifically, when one of the at least one frame corresponding to the specific phoneme among the acoustic feature information is input to the second neural network model, pieces of second speech data, the number of which corresponds to the identified number of loops, may be obtained. In addition, a set of a plurality of second speech data obtained through the at least one frame corresponding to the specific phoneme among the acoustic feature information may be first speech data corresponding to the specific phoneme. In other words, the second speech data may be speech data corresponding to one frame of the acoustic feature information and the first speech data may be speech data corresponding to one specific phoneme.

In an example, speech data at a first frequency is obtained based on acoustic feature information in which a shift size is a first time interval, and when a value of the utterance speed adjustment information is a reference value, one frame included in the acoustic feature information is input to the second neural network model, thereby obtaining the second speech data, the number of which corresponds to the product of the first time interval and the first frequency.

Figure 10:
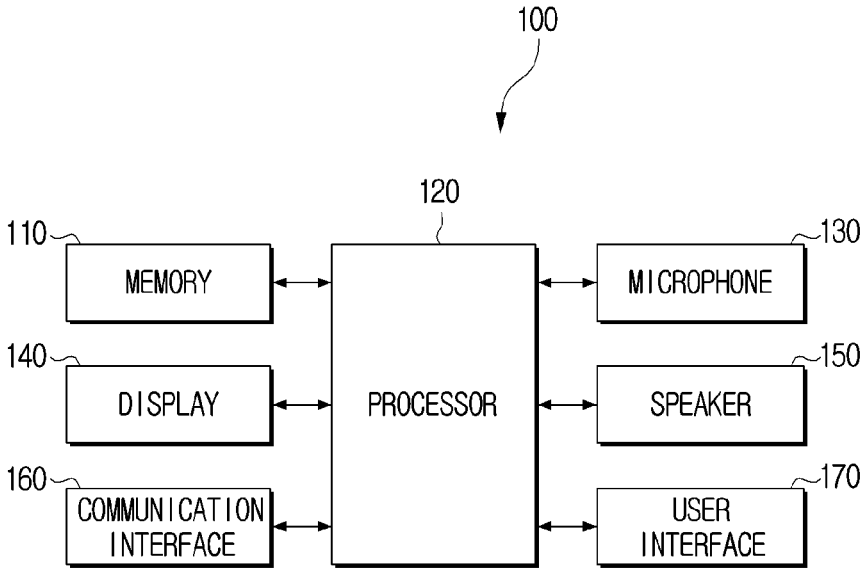
FIG. 10 is a block diagram illustrating a configuration of the electronic device according to an example embodiment

FIG. 10 is a block diagram illustrating a configuration of an electronic device according to an example embodiment. Referring to FIG. 10, the electronic device 100 may include a memory 110, a processor 120, a microphone 130, a display 140, a speaker 150, a communication interface 160, and a user interface 170. The memory 110 and the processor 120 illustrated in FIG. 10 are overlapped with the memory 110 and the processor 120 illustrated in FIG. 1, and therefore the description thereof will not be repeated. In addition, according to an implementation example of the electronic device 100, some of the constituent elements of FIG. 10 may be removed or other constituent elements may be added.

The microphone 130 is a constituent element for the electronic device 100 to receive an input of a speech signal. Specifically, the microphone 130 may receive an external speech signal using a microphone and process this as electrical speech data. In this case, the microphone 130 may transfer the processed speech data to the processor 120.

The display 140 is a constituent element for the electronic device 100 to provide information visually. The electronic device 100 may include one or more displays 140 and may display a text to be converted into speech data, a UI for obtaining evaluation information from a user, and the like through the display 140. In this case, the display 140 may be implemented as a Liquid Crystal Display (LCD), Plasma Display Panel (PDP), Organic Light Emitting Diodes (OLED), Transparent OLED (TOLED), Micro LED, and the like. Also, the display 140 may be implemented as a touch screen type capable of sensing a touch manipulation of a user and may also be implemented as a flexible display capable of being folded or curved. Particularly, the display 140 may visually provide a response corresponding to a command included in the speech signal.

The speaker 150 is a constituent element for the electronic device 100 to provide information acoustically. The electronic device 100 may include one or more speakers 150 and output the speech data obtained according to the disclosure as an audio signal through the speaker 150. The constituent element for outputting the audio signal may be implemented as the speaker 150, but this is merely an embodiment, and may also be implemented as an output terminal.

The communication interface 160 is a constituent element capable of communicating with an external device. The communication connection of the communication interface 160 with the external device may include communication via a third device (e.g., a repeater, a hub, an access point, a server, a gateway, or the like). The wireless communication, for example, may include a cellular communication using at least one among long-term evolution (LTE), LTE Advance (LTE-A), code division multiple access (CDMA), wideband CDMA (WCDMA), universal mobile telecommunications system (UMTS), Wireless Broadband (WiBro), and Global System for Mobile Communications (GSM). According to an embodiment, the wireless communication may include at least one of, for example, wireless fidelity (WiFi), Bluetooth, Bluetooth Low Energy (BLE), Zigbee, near field communication (NFC), Magnetic Secure Transmission, radio frequency (RF), or body area network (BAN). The wired communication may include at least one of, for example, universal serial bus (USB), high definition multimedia interface (HDMI), recommended standard232 (RS-232), power line communication, or plain old telephone service (POTS). The network for the wireless communication and the wired communication may include at least one of a telecommunication network, for example, a computer network (e.g., LAN or WAN), the Internet, or a telephone network.

Particularly, the communication interface 160 may provide the speech recognition function to the electronic device 100 by communicating with an external server. However, the disclosure is not limited thereto, and the electronic device 100 may provide the speech recognition function within the electronic device 100 without the communication with an external server.

The user interface 170 is a constituent element for receiving a user command for controlling the electronic device 100. Particularly, the user interface 170 may be implemented as a device such as a button, a touch pad, a mouse, and a keyboard, and may also be implemented as a touch screen capable of performing the display function and the manipulation input function. Herein, the button may be various types of buttons such as a mechanical button, a touch pad, or a wheel formed in any region of a front portion, a side portion, or a rear portion of the exterior of the main body of the electronic device 100.

It should be understood that the present disclosure includes various modifications, equivalents, and/or alternatives of the embodiments of the present disclosure. In relation to explanation of the drawings, similar drawing reference numerals may be used for similar constituent elements.

In this disclosure, the terms such as "comprise", "may comprise", "consist of", or "may consist of" are used herein to designate a presence of corresponding features (e.g., constituent elements such as number, function, operation, or part), and not to preclude a presence of additional features.

In the description, the term "A or B", "at least one of A or/and B", or "one or more of A or/and B" may include all possible combinations of the items that are enumerated together. For example, the term "A or B" or "at least one of A or/and B" may designate (1) at least one A, (2) at least one B, or (3) both at least one A and at least one B. In the description, the terms "first, second, and so forth" are used to describe diverse constituent elements regardless of their order and/or importance and to discriminate one constituent element from another, but are not limited to the corresponding constituent elements.

If it is described that a certain element (e.g., first element) is "operatively or communicatively coupled with/to" or is "connected to" another element (e.g., second element), it should be understood that the certain element may be connected to the other element directly or through still another element (e.g., third element). On the other hand, if it is described that a certain element (e.g., first element) is "directly coupled to" or "directly connected to" another element (e.g., second element), it may be understood that there is no element (e.g., third element) between the certain element and another element.

In the description, the term "configured to" may be changed to, for example, "suitable for", "having the capacity to", "designed to", "adapted to", "made to", or "capable of" under certain circumstances. The term "configured to (set to)" does not necessarily mean "specifically designed to" in a hardware level. Under certain circumstances, the term "device configured to" may refer to "device capable of" doing something together with another device or components. For example, the phrase "a unit or a processor configured (or set) to perform A, B, and C" may refer, for example, to a dedicated processor (e.g., an embedded processor) for performing the corresponding operations, a generic-purpose processor (e.g., a central processing unit (CPU) or an application processor), or the like, that can perform the corresponding operations by executing one or more software programs stored in a memory device.

The term "unit" or "module" as used herein includes units made up of hardware, software, or firmware, and may be used interchangeably with terms such as logic, logic blocks, components, or circuits. A "unit" or "module" may be an integrally constructed component or a minimum unit or part thereof that performs one or more functions. For example, the module may be implemented as an application-specific integrated circuit (ASIC).

Various embodiments of the disclosure may be implemented as software including instructions stored in machine (e.g., computer)-readable storage media. The machine is a device capable of calling the instructions stored in the storage medium and operating according to the called instructions and may include a laminated display device according to the disclosed embodiment. In a case where the instruction is executed by a processor, the processor may perform a function corresponding to the instruction directly or using other elements under the control of the processor. The instruction may include a code made by a compiler or a code executable by an interpreter. The machine-readable storage medium may be provided in a form of a non-transitory storage medium. Here, the "non-transitory" storage medium is tangible and may not include signals, and it does not distinguish that data is semi-permanently or temporarily stored in the storage medium.

According to an embodiment, the methods according to various embodiments disclosed in this disclosure may be provided in a computer program product. The computer program product may be exchanged between a seller and a purchaser as a commercially available product. The computer program product may be distributed in the form of a machine-readable storage medium (e.g., compact disc read only memory (CD-ROM)) or distributed on line through an application store (e.g., PlayStore™). In a case of the on-line distribution, at least a part of the computer program product may be at least temporarily stored or temporarily generated in a storage medium such as a memory of a server of a manufacturer, a server of an application store, or a relay server.

Each of the elements (e.g., a module or a program) according to various embodiments described above may include a single entity or a plurality of entities, and some sub-elements of the above-mentioned sub-elements may be omitted or other sub-elements may be further included in various embodiments. Alternatively or additionally, some elements (e.g., modules or programs) may be integrated into one entity to perform the same or similar functions performed by each respective element prior to the integration. Operations performed by a module, a program, or other elements, in accordance with various embodiments, may be performed sequentially, in a parallel, repetitive, or heuristically manner, or at least some operations may be performed in a different order, omitted, or may add a different operation.

What is claimed is:

1. A method for controlling an electronic device, the method comprising:

obtaining a text;

obtaining, by inputting the text into a first neural network model, acoustic feature information corresponding to the text and alignment information in which each frame of the acoustic feature information is matched with each phoneme included in the text;

identifying an utterance speed of the acoustic feature information based on the alignment information;

identifying a reference utterance speed for each phoneme included in the acoustic feature information based on the text and the acoustic feature information;

obtaining utterance speed adjustment information based on the utterance speed of the acoustic feature information and the reference utterance speed for each phoneme; and obtaining, based on the utterance speed adjustment information, speech data corresponding to the text by inputting the acoustic feature information into a second neural network model.

2. The method of claim 1, wherein the identifying the utterance speed of the acoustic feature information comprises identifying an utterance speed corresponding to a first phoneme included in the acoustic feature information based on the alignment information, and wherein the identifying the reference utterance speed for each phoneme comprises:

identifying the first phoneme included in the acoustic feature information based on the acoustic feature information; and identifying a reference utterance speed corresponding to the first phoneme based on the text.

3. The method of claim 2, wherein the identifying the reference utterance speed corresponding to the first phoneme comprises:

obtaining a first reference utterance speed corresponding to the first phoneme based on the text, and obtaining sample data used for training the first neural network model.

4. The method of claim 3, wherein the identifying the reference utterance speed corresponding to the first phoneme further comprises:

obtaining evaluation information for the sample data used for training the first neural network model; and identifying a second reference utterance speed corresponding to the first phoneme based on the first reference utterance speed corresponding to the first phoneme and the evaluation information, and wherein the evaluation information is obtained by a user of the electronic device.

5. The method of claim 4, further comprising:

identifying the reference utterance speed corresponding to the first phoneme based on one of the first reference utterance speed and the second reference utterance speed.

6. The method of claim 2, wherein the identifying the utterance speed corresponding to the first phoneme further comprises identifying an average utterance speed corresponding to the first phoneme based on the utterance speed corresponding to the first phoneme and an utterance speed corresponding to at least one phoneme before the first phoneme among the acoustic feature information, and wherein the obtaining the utterance speed adjustment information comprises obtaining utterance speed adjustment information corresponding to the first phoneme based on the average utterance speed corresponding to the first phoneme and the reference utterance speed corresponding to the first phoneme.

7. The method of claim 2, wherein the second neural network model comprises an encoder configured to receive an input of the acoustic feature information and a decoder configured to receive an input of vector information output from the encoder, wherein the obtaining the speech data comprises:

while at least one frame corresponding to the first phoneme among the acoustic feature information is input to the second neural network model, identifying a number of loops of the decoder included in the second neural network model based on utterance speed adjustment information corresponding to the first phoneme; and obtaining the at least one frame corresponding to the first phoneme and a number of pieces of first speech data, the number of pieces of first speech data corresponding to the number of loops, based on the input of the at least one frame corresponding to the first phoneme to the second neural network model, and wherein the first speech data comprises speech data corresponding to the first phoneme.

8. The method of claim 7, wherein, based on one of the at least one frame corresponding to the first phoneme among the acoustic feature information being input to the second neural network model, a number of pieces of second speech data are obtained, the number of pieces of second speech data corresponding to the number of loops.

9. The method of claim 7, wherein the decoder is configured to obtain speech data at a first frequency based on acoustic feature information in which a shift size is a first time interval, and wherein, based on a value of the utterance speed adjustment information being a reference value, one frame included in the acoustic feature information is input to the second neural network model and a second number of pieces of speech data is obtained, the second number of pieces of speech data corresponds to a product of the first time interval and the first frequency.

10. The method of claim 1, wherein the utterance speed adjustment information comprises information on a ratio value of the utterance speed of the acoustic feature information and the reference utterance speed of each phoneme.

11. An electronic device comprising:

a memory configured to store instructions; and a processor configured to execute the instructions to:

obtain a text;

obtain, by inputting the text to a first neural network model, acoustic feature information corresponding to the text and alignment information in which each frame of the acoustic feature information is matched with each phoneme included in the text;

identify an utterance speed of the acoustic feature information based on the alignment information;

identify a reference utterance speed for each phoneme included in the acoustic feature information based on the text and the acoustic feature information;

obtain utterance speed adjustment information based on the utterance speed of the acoustic feature information and the reference utterance speed for each phoneme; and obtain, based on the utterance speed adjustment information, speech data corresponding to the text by inputting the acoustic feature information to a second neural network model.

12. The electronic device of claim 11, wherein the processor is further configured to execute the instructions to:

identify an utterance speed corresponding to a first phoneme included in the acoustic feature information based on the alignment information;

identify the first phoneme included in the acoustic feature information based on the acoustic feature information; and identify a reference utterance speed corresponding to the first phoneme based on the text.

13. The electronic device of claim 12, wherein the processor is further configured to execute the instructions to:

obtain a first reference utterance speed corresponding to the first phoneme based on the text, and obtain sample data used for training the first neural network model.

14. The electronic device of claim 13, wherein the processor is further configured to execute the instructions to:

obtain evaluation information for the sample data used for training the first neural network model; and identify a second reference utterance speed corresponding to the first phoneme based on the first reference utterance speed corresponding to the first phoneme and the evaluation information, and wherein the evaluation information is obtained by a user of the electronic device.

15. The electronic device of claim 14, wherein the processor is further configured to execute the instructions to:

identify the reference utterance speed corresponding to the first phoneme based on one of the first reference utterance speed and the second reference utterance speed.

16. The electronic device of claim 12, wherein the processor is configured to execute the instructions to identify the utterance speed corresponding to the first phoneme by identifying an average utterance speed corresponding to the first phoneme based on the utterance speed corresponding to the first phoneme and an utterance speed corresponding to at least one phoneme before the first phoneme among the acoustic feature information, and wherein the processor is configured to execute the instructions to obtain the utterance speed adjustment information by obtaining utterance speed adjustment information corresponding to the first phoneme based on the average utterance speed corresponding to the first phoneme and the reference utterance speed corresponding to the first phoneme.

17. The electronic device of claim 12, wherein the second neural network model comprises an encoder configured to receive an input of the acoustic feature information and a decoder configured to receive an input of vector information output from the encoder, wherein the processor is configured to execute the instructions to obtain the speech data by:

while at least one frame corresponding to the first phoneme among the acoustic feature information is input to the second neural network model, identifying a number of loops of the decoder included in the second neural network model based on utterance speed adjustment information corresponding to the first phoneme; and obtaining the at least one frame corresponding to the first phoneme and a number of pieces of first speech data, the number of pieces of first speech data corresponding to the number of loops, based on the input of the at least one frame corresponding to the first phoneme to the second neural network model, and wherein the first speech data comprises speech data corresponding to the first phoneme.

18. The electronic device of claim 17, wherein, based on one of the at least one frame corresponding to the first phoneme among the acoustic feature information being input to the second neural network model, the processor is further configured to execute the instructions to obtain a number of pieces of second speech data, the number of pieces of second speech data corresponding to the number of loops.

19. The electronic device of claim 17, wherein the decoder is configured to obtain speech data at a first frequency based on acoustic feature information in which a shift size is a first time interval, and wherein, based on a value of the utterance speed adjustment information being a reference value, the processor is further configured to execute the instructions to obtain one frame included in the acoustic feature information is input to the second neural network model and a second number of pieces of speech data, the second number of pieces of speech data corresponds to a product of the first time interval and the first frequency.

20. The electronic device of claim 11, wherein the utterance speed adjustment information comprises information on a ratio value of the utterance speed of the acoustic feature information and the reference utterance speed of each phoneme.

* * * * *